United States Patent [19]

Dushku

[11] 4,243,205

[45] Jan. 6, 1981

[54] LOG BREAKING DEVICE

[76] Inventor: Victor A. Dushku, Rackarbergsgatan 34, 2 TR., 752 32 Upsala, Sweden

[21] Appl. No.: 74,745

[22] Filed: Sep. 12, 1979

[51] Int. Cl.[3] ..... B66F 15/00

[52] U.S. Cl. ..... 254/113; 144/34 A; 254/104; 254/131

[58] Field of Search ..... 254/113, 122, 123, 120, 254/131, 104, 8 B, 9 B, 10 B; 144/34 R, 34 A, 34 B, 193

[56] References Cited

U.S. PATENT DOCUMENTS

| | | | |
|---|---|---|---|
| 1,380,405 | 6/1921 | Mulvane | 254/122 |
| 1,480,046 | 1/1924 | Carter | 254/122 |
| 2,504,176 | 4/1950 | Brehmer | 254/104 |
| 3,548,899 | 12/1970 | Emerson | 144/34 B |
| 4,030,700 | 6/1977 | Dushku | 254/113 |

*Primary Examiner*—Robert C. Watson

*Attorney, Agent, or Firm*—Roylance, Abrams, Berdo & Farley

[57] ABSTRACT

A manually operated device for use in tree falling comprises an elongated manually operable lever having a first pressure plate at one end and a second pressure plate hinged to the first pressure plate. A pressure member is connected in spaced relation to the pressure plates by two links pivotally interconnected directly with the pressure member at one of their respective ends. The other ends of the links are connected to the pressure plates. Raising the lever causes the first pressure plate to pivot in relation to the second pressure plate and the links to raise the pressure member which bears against the tree sawcut, consequently felling the tree.

13 Claims, 7 Drawing Figures

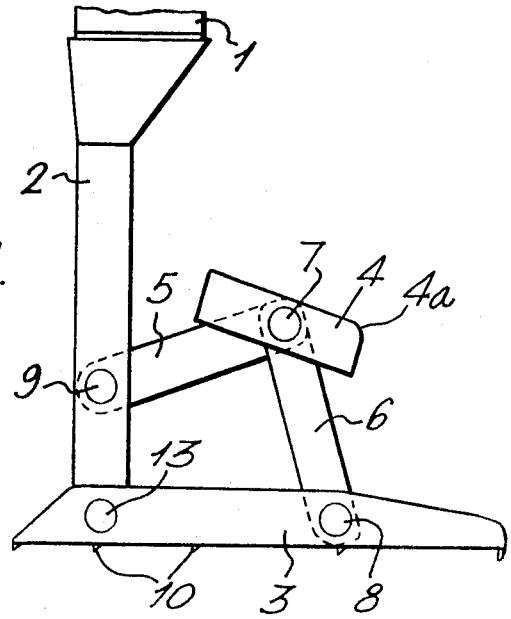
FIG.1.
FIG.4.
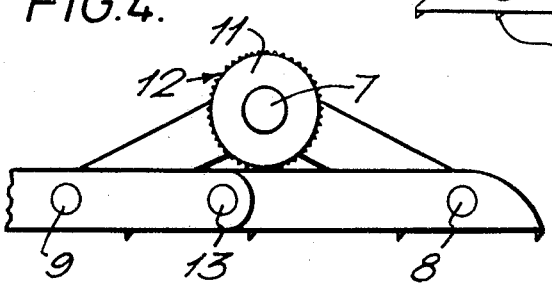
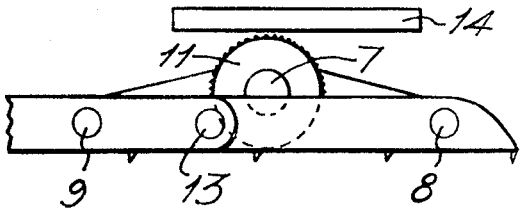
FIG.5.
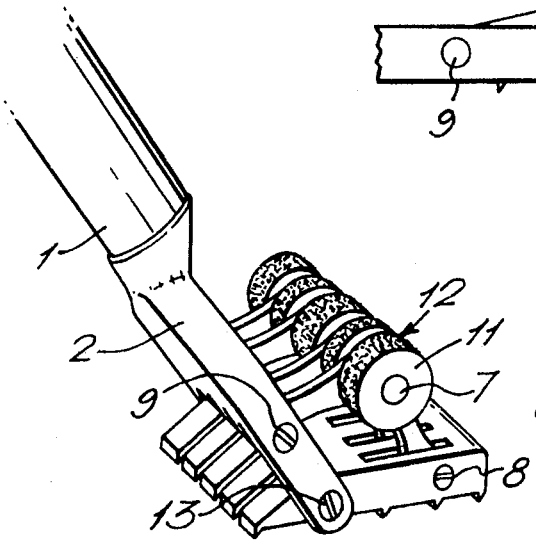
FIG.6.

FIG.2.
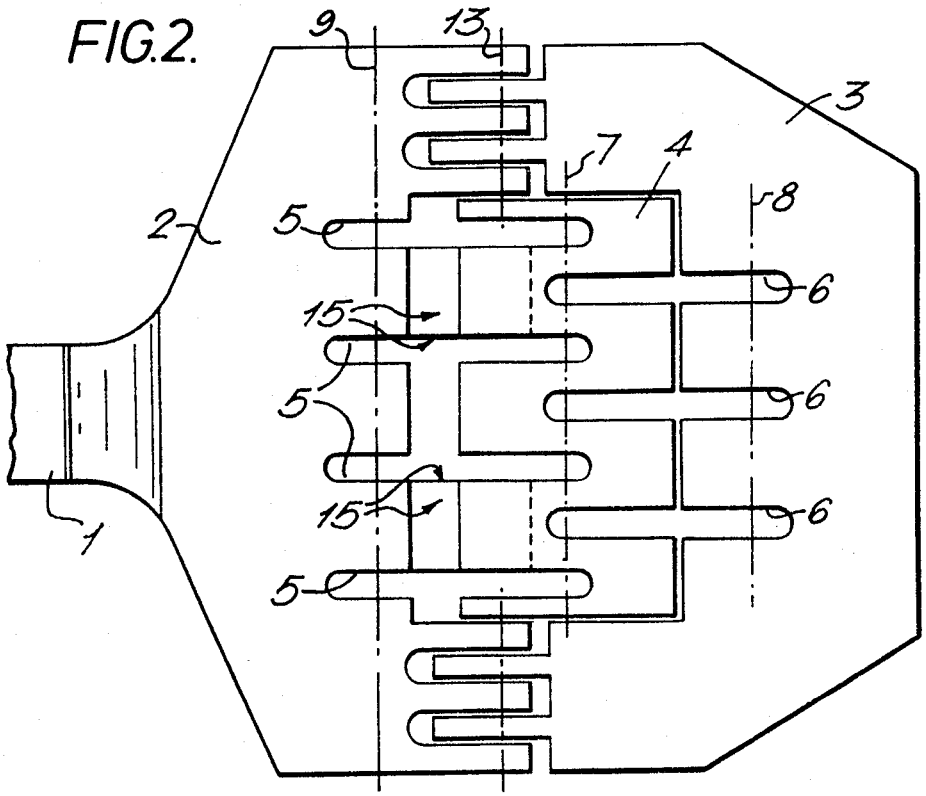
FIG.3.
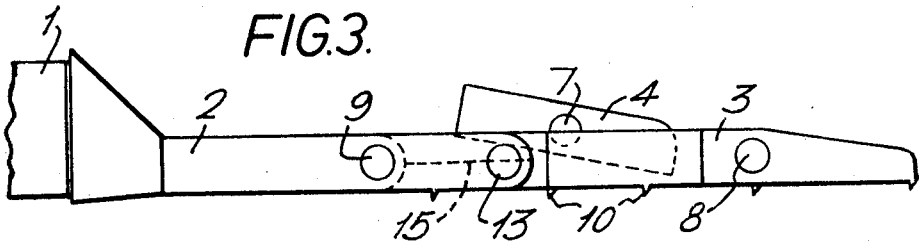
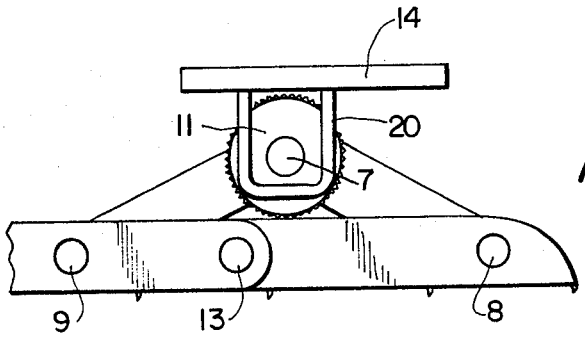
FIG. 7